US011333058B2

(12) United States Patent
Barratt

(10) Patent No.: US 11,333,058 B2
(45) Date of Patent: May 17, 2022

(54) MARINE OUTBOARD MOTOR WITH DRIVE SHAFT AND COOLING SYSTEM

(71) Applicant: COX POWERTRAIN LIMITED, Shoreham-By-Sea (GB)

(72) Inventor: James Barratt, Shoreham-By-Sea (GB)

(73) Assignee: COX POWERTRAIN LIMITED, Shoreham-By-Sea (GB)

( * ) Notice: Subject to any disclaimer, the term of this patent is extended or adjusted under 35 U.S.C. 154(b) by 173 days.

(21) Appl. No.: 16/796,247

(22) Filed: Feb. 20, 2020

(65) Prior Publication Data

US 2020/0284184 A1 Sep. 10, 2020

(30) Foreign Application Priority Data

Mar. 7, 2019 (GB) ..... 1903086

(51) Int. Cl.
*F01P 3/20* (2006.01)
*B63H 20/28* (2006.01)
(Continued)

(52) U.S. Cl.
CPC ..... *F01P 3/202* (2013.01); *B63H 20/285* (2013.01); *F01P 5/12* (2013.01); *F02B 61/045* (2013.01); *F01P 2003/001* (2013.01)

(58) Field of Classification Search
CPC ..... F01P 3/202; F01P 5/12; F01P 2003/001; B63H 20/24; B63H 20/28
See application file for complete search history.

(56) References Cited

U.S. PATENT DOCUMENTS 1,843,089 A * 1/1932 Peck ..... F01P 3/202 440/75
6,146,223 A 11/2000 Karls et al.
(Continued)

FOREIGN PATENT DOCUMENTS

CH 299921 6/1954
CH 299921 A * 6/1954 ..... B63H 20/245
WO WO 2018/132407 7/2018

OTHER PUBLICATIONS

Search and Examination Report issued in Appl. No. GB1903086.5 (2019).

(Continued)

*Primary Examiner* — Andrew Polay
(74) *Attorney, Agent, or Firm* — Barnes & Thornburg LLP

(57) ABSTRACT

A marine outboard motor for a marine vessel. The marine outboard motor includes: a housing comprising a chamber and at least one inlet arranged to be submerged, in use, into a body of water in which the marine outboard motor is operated, in order to draw water into the chamber; an engine assembly comprising an internal combustion engine; a drive shaft positioned in the housing, wherein the drive shaft is coupled to the internal combustion engine to drive a propulsion arrangement; a cooling system for cooling the internal combustion engine, the cooling system configured convey drawn water along a coolant flow path through the housing to deliver the drawn water to the internal combustion engine; and a sleeve by which the drive shaft is sealed from drawn water within the housing, the sleeve having first and second ends, wherein at least a part of the drive shaft is encased within the sleeve.

15 Claims, 5 Drawing Sheets

(51) Int. Cl.

| | |
|---|---|
| ***F01P 5/12*** | (2006.01) |
| ***F02B 61/04*** | (2006.01) |
| *F01P 3/00* | (2006.01) |

(56) References Cited

U.S. PATENT DOCUMENTS

| | | | | |
|---|---|---|---|---|
| 2004/0165985 | A1 | 8/2004 | Satoh et al. | |
| 2007/0107424 | A1* | 5/2007 | Wizgall | F01P 3/207 60/597 |
| 2009/0209148 | A1 | 8/2009 | Fukuoka | |
| 2014/0057507 | A1 | 2/2014 | Kuriyagawa et al. | |
| 2016/0185433 | A1 | 6/2016 | Achiwa et al. | |

OTHER PUBLICATIONS

Search Report & Written Opinion issued in Int'l Appl. No. PCT/GB2020/050521 (2020).

* cited by examiner

MARINE OUTBOARD MOTOR WITH DRIVE SHAFT AND COOLING SYSTEM

CROSS REFERENCE TO RELATED APPLICATIONS

This application claims priority to United Kingdom application no. 1903086.5, filed Mar. 7, 2019. The disclosure set forth in the referenced application is incorporated herein by reference in its entirety.

TECHNICAL FIELD

The present invention relates to a marine outboard motor. While this application relates to marine outboard motors, the teachings may also be applicable to any other internal combustion engine.

BACKGROUND

In order to propel a marine vessel, an outboard motor is often attached to the stern of the vessel. The outboard motor is generally formed of three sections: an upper powerhead including an internal combustion engine; a lower-section including a propeller hub connected to the internal combustion engine via a drive shaft; and a middle section defining an exhaust gas flow path for transporting exhaust gases from the upper section to the lower section.

The limited amount of available space in the cowling can lead to increased cooling requirements for the internal combustion engine. This is primarily because the close proximity of the cowling can restrict the dissipation of heat generated by the engine to the surroundings. High operating temperatures in the engine can be detrimental to engine performance and durability. Thus it is important to ensure that adequate cooling is provided for the engine.

The housing of the marine outboard includes one or more apertures intended to be submerged, in use, into a body of water in which the marine outboard motor is operated. This results in water being drawn into a chamber within the housing (i.e. within the middle section) in operation. To ensure adequate cooling, marine outboard motors typically include an open circuit cooling system. A water pump is provided so as to convey at least some of the water drawn into the chamber within the marine outboard housing along a flow path to at least one coolant passage in the internal combustion engine to draw heat from the engine before returning to the body of water via one or more drain lines.

In known systems, the water drawn into the chamber within the housing flows over the surface of the drive shaft, which can result in degradation of the drive shaft e.g. from corrosion. In order to minimise this degradation, different sections of the drive shaft may be formed from different materials that are then welded together. The section of the drive shaft exposed to the water are often formed from a corrosion resistant material (e.g. stainless steel) with the unexposed section being formed from higher strength materials (e.g. high strength steel). This composite welded structure of the drive shaft increases the cost of producing the drive shaft, and may result in sub-optimal drive shaft mechanical properties.

The present invention seeks to provide an improved marine outboard motor which overcomes or mitigates one or more problems associated with the prior art.

SUMMARY OF THE INVENTION

According to a first aspect of the present invention, there is provided a marine outboard motor for a marine vessel, the marine outboard motor comprising: a housing comprising a chamber and at least one inlet arranged to be submerged, in use, into a body of water in which the marine outboard motor is operated, in order to draw water into the chamber; an engine assembly comprising an internal combustion engine; a drive shaft positioned in the housing, wherein the drive shaft is coupled to the internal combustion engine to drive a propulsion arrangement; a cooling system for cooling the internal combustion engine, the cooling system configured convey drawn water along a coolant flow path through the housing to deliver the drawn water to the internal combustion engine; and a sleeve by which the drive shaft is sealed from drawn water within the housing, the sleeve having first and second ends, wherein at least a part of the drive shaft is encased within the sleeve.

Traditionally, the drive shaft is provided along the coolant flow path. The present arrangement ensures that the drive shaft is sealed away from the coolant flow path, thus reducing interaction between the drive shaft and the drawn water.

By providing a drive shaft that is sealed away from the coolant flow path, interaction between water from a body of water in which the marine outboard motor is operated in use and the drive shaft is prevented, which reduces corrosion of the drive shaft caused by interaction of the drawn water and the drive shaft. This, in turn, allows for a wider range of materials to be used for producing the drive shaft, which can allow for cheaper materials to be used.

In previous systems, dynamic seals were required on the drive shaft to prevent the water from a body of water in which the marine outboard motor is operated in use from leaking into the rest of the motor, e.g. into the transmission. Sealing the drive shaft from the coolant flow path removes the requirement for dynamic seals to be provided on the drive shaft.

The sleeve may be fixed within the housing such that the drive shaft is rotatable relative to the sleeve.

Providing a fixed sleeve within the housing (having the drive shaft rotating within) removes the need for dynamic seals between the sleeve and the housing, and is more reliable than dynamic seals.

The sleeve may comprise a plurality of sleeve sections, each sleeve section encasing a different part of the drive shaft.

This arrangement advantageously allows the material of the sleeve to be varied along different parts of the drive shaft. This reduces the cost of the sleeve, and eases manufacture thereof.

The housing may comprise an exhaust system connected to the engine assembly by an adapter plate. The first end of the sleeve may be sealingly coupled to the adapter plate.

This arrangement of sealing the first end (i.e. an upper end) of the sleeve to the adapter plate prevents drawn water from leaking into the engine assembly.

A first sleeve section may sealingly couple the housing to the adapter plate.

The first sleeve section may be integrally formed, e.g. integrally cast, with the housing.

Providing a part of the sleeve that is integrally formed with the housing reduces the weight of the marine outboard motor.

A water pump drive mechanism may be disposed within a pump drive mechanism housing. A second sleeve section may be sealingly coupled between the first sleeve section and the pump drive mechanism housing.

This arrangement advantageously ensures that the arrangement for driving the water pump (i.e. the impellor) is also sealed away from the water flowing through the coolant flow path.

The marine outboard motor may comprise a drive transmission for the propulsion arrangement, the drive transmission being disposed within a drive transmission housing. The second end of the sleeve may be mounted to the transmission housing such that a seal is formed therebetween.

This arrangement of sealing the second end (i.e. a lower end) of the sleeve to the drive transmission prevents drawn water from leaking into the drive transmission.

A water pump drive mechanism may be disposed within a pump drive mechanism housing. A third sleeve section may be sealingly coupled between the transmission housing and the pump drive mechanism housing.

The cooling system may comprise a water pump configured to propel the drawn water along the coolant flow path.

This arrangement ensures that there is a sufficient flow of water to cool the internal combustion engine.

The water pump may be separate from the drive shaft and is configured to be driven by the drive shaft.

This arrangement enables the pump impellor to be driven by the drive shaft without requiring the pump to be mounted directly onto the drive shaft.

The water pump may comprise a pump drive mechanism including a water pump drive shaft. The water pump drive shaft may be separate from the drive shaft and may be configured to be driven by the drive shaft.

The water pump may be coupled to the drive shaft by a pump drive mechanism having a gear ratio of greater that 1:1.

Providing a step-up transmission allows for the rotational speed of the impeller to be greater than that of the drive shaft, increasing the flow rate of drawn water through the cooling system, thus proving improves cooling of the internal combustion engine.

The pump drive mechanism comprises a drive gear mounted concentrically on the drive shaft, and a driven gear mounted concentrically on the water pump drive shaft, wherein the drive gear and driven gear are in meshing engagement.

Providing a drive gear that is rotatably fixed onto the drive shaft ensures that the motive power transmitted by the drive shaft can be used to drive the cooling system.

The driveshaft may extend in a vertical direction.

The internal combustion engine may be a diesel engine.

The engine block may comprise a single cylinder. Preferably, the engine block comprises a plurality of cylinders.

As used herein, the term "engine block" refers to a solid structure in which at least one cylinder of the engine is provided. The term may refer to the combination of a cylinder block with a cylinder head and crankcase, or to the cylinder block only. The engine block may be formed from a single engine block casting. The engine block may be formed from a plurality of separate engine block castings which are connected together, for example using bolts.

The engine block may comprise a single cylinder bank.

The engine block may comprise a first cylinder bank and a second cylinder bank. The first and second cylinder banks may be arranged in a V configuration.

The engine block may comprise three cylinder banks. The three cylinder banks may be arranged in a broad arrow configuration. The engine block may comprise four cylinder banks. The four cylinder banks may be arranged in a W or double-V configuration.

The internal combustion engine may be arranged in any suitable orientation. Preferably, the internal combustion engine is a vertical axis internal combustion engine. In such an engine, the internal combustion engine comprises a crankshaft which is mounted vertically in the engine.

The internal combustion engine may be a petrol engine. Preferably, the internal combustion engine is a diesel engine. The internal combustion engine may be a turbocharged diesel engine.

According to a second aspect of the present invention, there is provided a marine vessel comprising the marine outboard motor of the first aspect.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Further features and advantages of the present invention will be further described below, by way of example only, with reference to the accompanying drawings in which.

DETAILED DESCRIPTION

Figure 1:
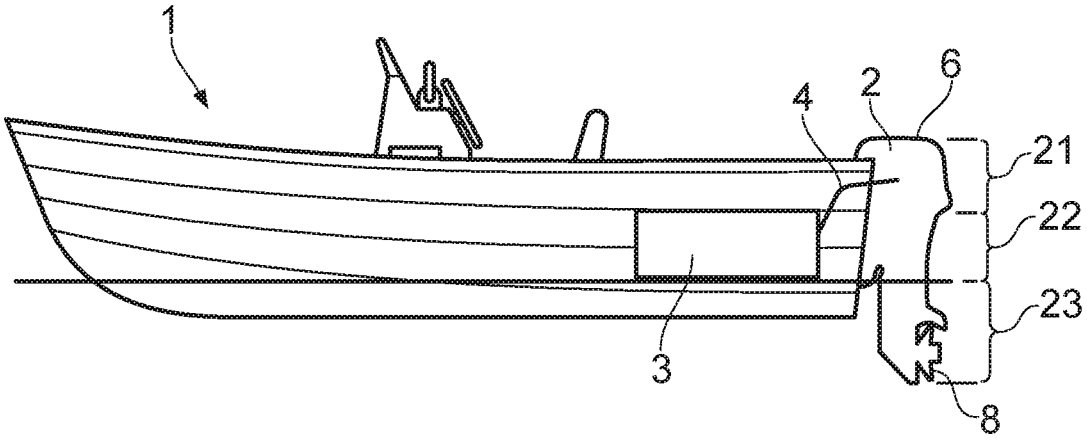
FIG. 1 is a schematic side view of a light marine vessel provided with a marine outboard motor.

Referring firstly to FIG. 1, there is shown a schematic side view of a marine vessel 1 with a marine outboard motor 2. The marine vessel 1 may be any kind of vessel suitable for use with a marine outboard motor, such as a tender or a scuba-diving boat. The marine outboard motor 2 shown in FIG. 1 is attached to the stern of the vessel 1. The marine outboard motor 2 is connected to a fuel tank 3, usually received within the hull of the marine vessel 1. Fuel from the reservoir or tank 3 is provided to the marine outboard motor 2 via a fuel line 4. Fuel line 4 may be a representation for a collective arrangement of one or more filters, low pressure pumps and separator tanks (for preventing water from entering the marine outboard motor 2) arranged between the fuel tank 3 and the marine outboard motor 2.

The marine outboard motor 2 is provided with a housing 6 within which various components of the motor 2 are housed. As will be described in more detail below, the marine outboard motor 2 is generally divided into three sections, an upper-section 21, a mid-section 22, and a lower-section 23. The mid-section 22 and lower-section 23 are often collectively known as the leg section, and the leg houses the exhaust system. A propulsion arrangement is provided including a propeller 8. The propeller 8 is rotatably arranged on a propeller shaft at the lower-section 23, also known as the gearbox, of the marine outboard motor 2. Of course, in operation, the propeller 8 is at least partly submerged in water and may be operated at varying rotational speeds to propel the marine vessel 1.

Typically, the marine outboard motor 2 is pivotally connected to the stern of the marine vessel 1 by means of a pivot pin. Pivotal movement about the pivot pin enables the operator to tilt and trim the marine outboard motor 2 about a horizontal axis in a manner known in the art. Further, as is well known in the art, the marine outboard motor 2 is also pivotally mounted to the stern of the marine vessel 1 so as to be able to pivot, about a generally upright axis, to steer the marine vessel 1.

Tilting is a movement that raises the marine outboard motor 2 far enough so that the entire marine outboard motor 2 is able to be raised completely out of the water. Tilting the marine outboard motor 2 may be performed with the marine outboard motor 2 turned off or in neutral. However, in some instances, the marine outboard motor 2 may be configured to allow limited running of the marine outboard motor 2 in the tilt range so as to enable operation in shallow waters. Marine engine assemblies are therefore predominantly operated with a longitudinal axis of the leg in a substantially vertical direction. As such, a crankshaft of an engine of the marine outboard motor 2 which is substantially parallel to a longitudinal axis of the leg of the marine outboard motor 2 will be generally oriented in a vertical orientation during normal operation of the marine outboard motor 2, but may also be oriented in a non-vertical direction under certain operating conditions, in particular when operated on a vessel in shallow water. A crankshaft of a marine outboard motor 2 which is oriented substantially parallel to a longitudinal axis of the leg of the engine assembly can also be termed a vertical crankshaft arrangement. A crankshaft of a marine outboard motor 2 which is oriented substantially perpendicular to a longitudinal axis of the leg of the engine assembly can also be termed a horizontal crankshaft arrangement.

Figure 2A:
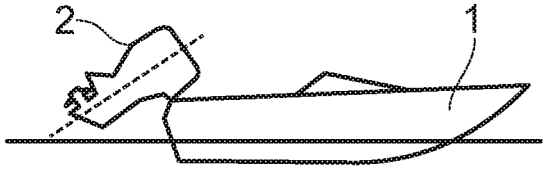
FIG. 2A shows a schematic representation of a marine outboard motor in its tilted position.

As mentioned previously, to work properly, the lower-section 23 of the marine outboard motor 2 needs to extend into the water. In extremely shallow waters, however, or when launching a vessel off a trailer, the lower-section 23 of the marine outboard motor 2 could drag on the seabed or boat ramp if in the tilted-down position. Tilting the marine outboard motor 2 into its tilted-up position, such as the position shown in FIG. 2A, prevents such damage to the lower-section 23 and the propeller 8.

Figure 2B:
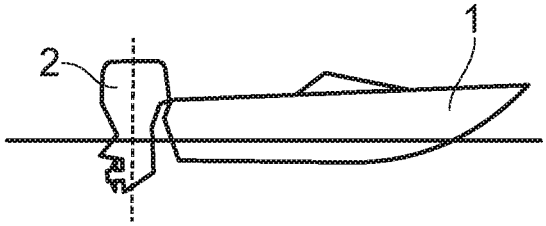
FIGS. 2B to 2D show various trimming positions of the marine outboard motor and the corresponding orientation of the marine vessel within a body of water.
Figure 2C:
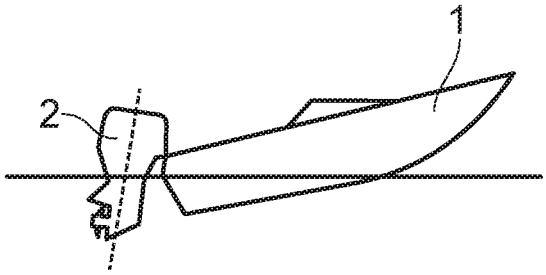
Figure 2D:
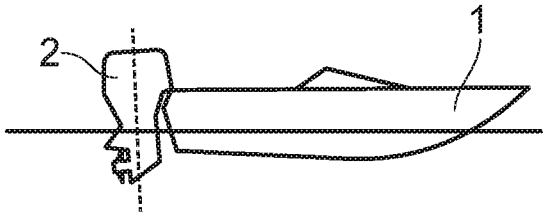

By contrast, trimming is the mechanism that moves the marine outboard motor 2 over a smaller range from a fully-down position to a few degrees upwards, as shown in the three examples of FIGS. 2B to 2D. Trimming helps to direct the thrust of the propeller 8 in a direction that will provide the best combination of fuel efficiency, acceleration and high speed operation of the marine vessel 1.

When the vessel 1 is on a plane (i.e. when the weight of the vessel 1 is predominantly supported by hydrodynamic lift, rather than hydrostatic lift), a bow-up configuration results in less drag, greater stability and efficiency. This is generally the case when the keel line of the boat or marine vessel 1 is up about three to five degrees, such as shown in FIG. 2B for example.

Too much trim-out puts the bow of the vessel 1 too high in the water, such as the position shown in FIG. 2C. Performance and economy, in this configuration, are decreased because the hull of the vessel 1 is pushing the water and the result is more air drag. Excessive trimming-out can also cause the propeller to ventilate, resulting in further reduced performance. In even more severe cases, the vessel 1 may hop in the water, which could throw the operator and passengers overboard.

Trimming-in will cause the bow of the vessel 1 to be down, which will help accelerate from a standing start. Too much trim-in, shown in FIG. 2D, causes the vessel 1 to "plough" through the water, decreasing fuel economy and making it hard to increase speed. At high speeds, trimming-in may even result in instability of the vessel 1.

Figure 3:
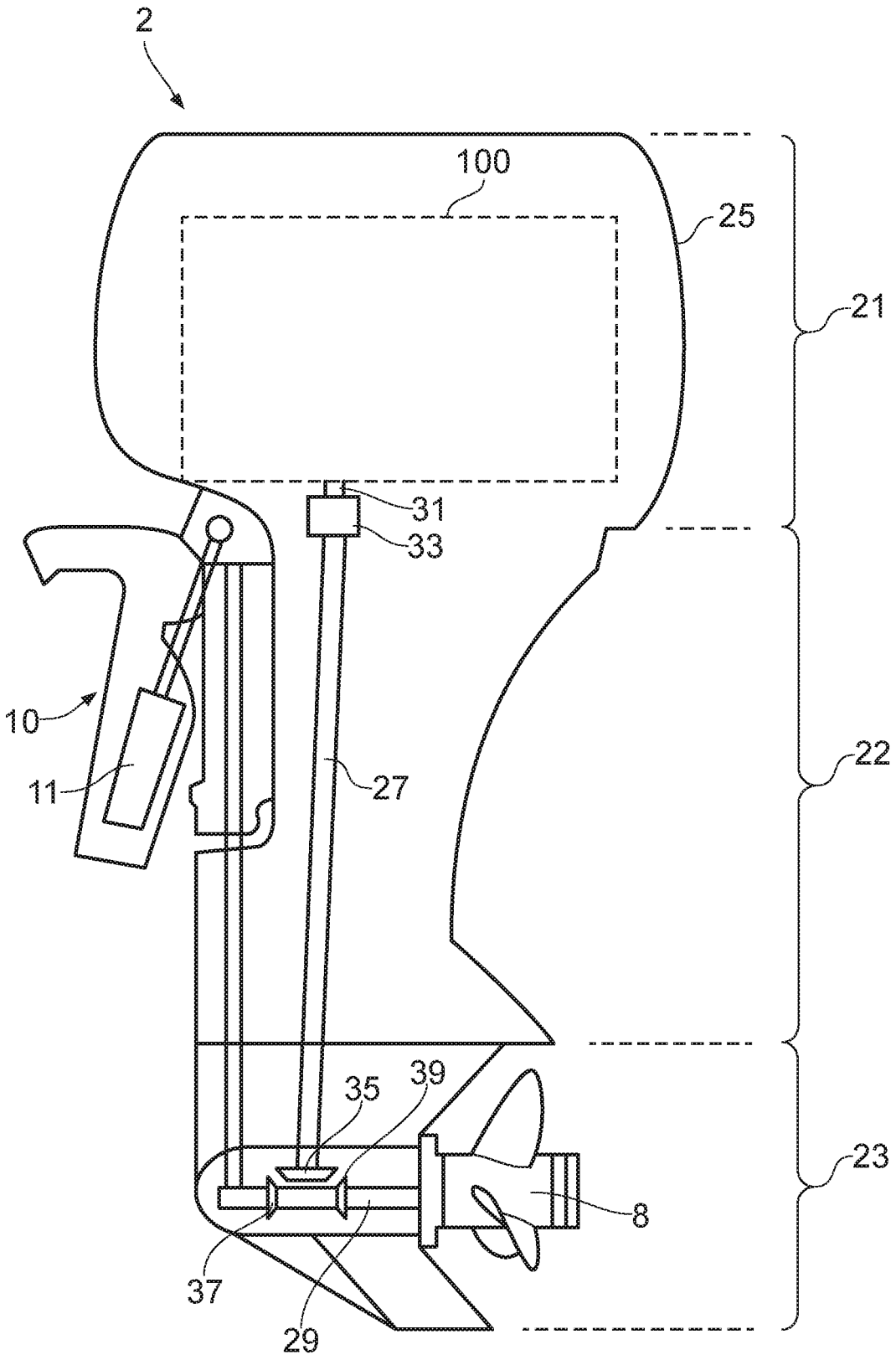
FIG. 3 shows a schematic cross-section of a marine outboard motor according to an embodiment.

Turning to FIG. 3, there is shown a schematic cross-section of an outboard motor 2 according to an embodiment of the present invention. The outboard motor 2 comprises a tilt and trim mechanism 10 for performing the aforementioned tilting and trimming operations. In this embodiment, the tilt and trim mechanism 10 includes a hydraulic actuator 11 that can be operated to tilt and trim the outboard motor 2 via an electric control system. Alternatively, it is also feasible to provide a manual tilt and trim mechanism, in which the operator pivots the outboard motor 2 by hand rather than using a hydraulic actuator.

As mentioned above, the outboard motor 2 is generally divided into three sections. An upper-section 21, also known as the powerhead, houses an engine assembly including an internal combustion engine 100 for powering the marine vessel 1. A cowling 25 is disposed around the engine 100. The cowling 25 may form part of the housing 6. The cowling 25 may be provided as a discrete component which is removably connected to the housing 6. The housing 6 may form a casing around the leg section while the cowling houses the upper section 21 of the motor 2.

Adjacent to, and extending below, the upper-section 21 or powerhead, there is provided a mid-section 22 and a lower section 23. The lower-section 23 extends adjacent to and below the mid-section 22, and the mid-section 22 connects the upper-section 21 to the lower-section 23. The mid-section 22 houses a drive shaft 27 which extends between the combustion engine 100 and the propeller shaft 29. The drive shaft 27 is connected at its upper end to a crankshaft 31 of the combustion engine via a floating connector 33 (e.g. a splined connection). At the lower end of the drive shaft 27, a gear box/drive transmission is provided that supplies the rotational energy of the drive shaft 27 to the propeller 8 in a horizontal direction. The gear box/drive transmission includes a transmission housing 61. In more detail, the bottom end of the drive shaft 27 may include a bevel gear 35 connected to a pair of bevel gears 37, 39 that are rotationally connected to the propeller shaft 29 of the propeller 8.

The mid-section 22 and lower-section 23 form an exhaust system, which defines an exhaust gas flow path for transporting exhaust gases from the internal combustion engine 100 and out of the outboard motor 2. The exhaust system is connected to the engine assembly by an adapter plate 41 to which the internal combustion engine 100 is mounted.

As shown schematically in FIG. 3, the marine outboard motor 2 is provided with a cooling system to convey water drawn from a body of water in which the marine outboard motor is operated in use along a coolant flow path 43 extending through the housing 6 to the combustion engine 100. The water is propelled around the coolant flow path 43 by the at least one water pump (see FIGS. 4 and 5) in order to cool the engine 100.

The housing 6 of the marine outboard motor 2 includes one or more apertures intended to be submerged, in use, into a body of water in which the marine outboard motor 2 is operated. Put another way, in use, water from a body of water in which the marine outboard motor 2 is operated passes into the housing 6 via one or more apertures in the housing 6 that are positioned below the waterline of the body of water, with the marine vessel 1 at rest. As will be discussed later, in the arrangement shown the one or more apertures are provided on the lower-section 23.

In the illustrated embodiment, the housing 6 includes a first inlet 45 and a second inlet 47 in the lower-section 23. Although not illustrated, the housing 6 is provided with third and fourth inlets at substantially the same positions as the first and second inlets 45, 47 on the opposing side of the housing 6. In alternative arrangements, the coolant flow path 43 may include any suitable number of inlets (e.g. one, two, five etc.) and/or the one or more of the inlets may be provided on the mid-section 22.

This arrangement of apertures positioned below the water line, in use, results in water in which the marine outboard motor 2 is operated being drawn into a chamber 52, 53 within the housing 6. In this way, the chambers 52, 53 within the housing 6 is continuously provided with drawn water from the body of water in which the marine outboard motor 2 is operated. As will be discussed in more detail below, the surface of the drive shaft 27 is sealed within the housing 6 such that the surface of the drive shaft 27 is not exposed to the drawn water drawn within the housing 6.

Figure 4:
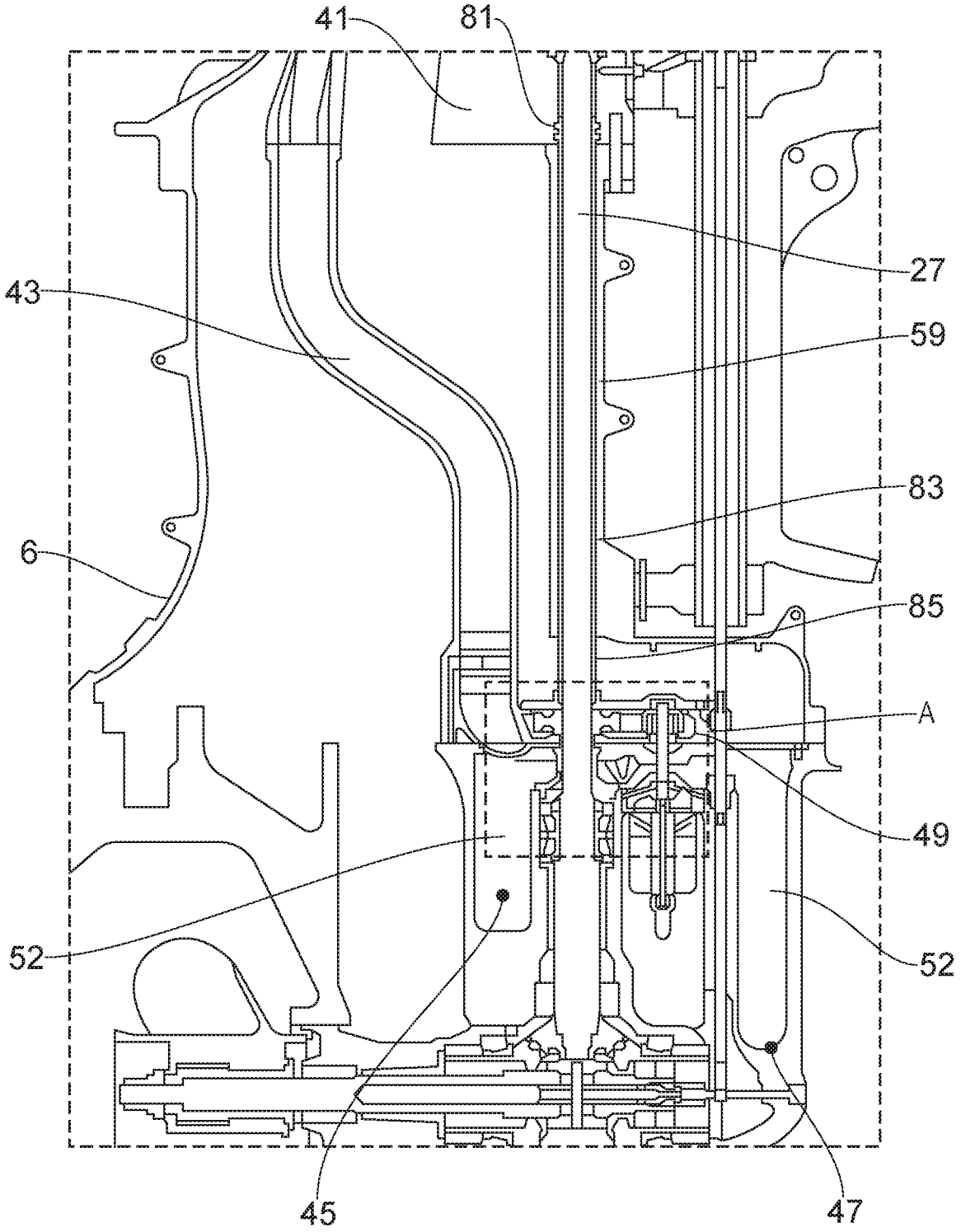
FIG. 4 shows a schematic cross-section of the mid-section and lower-section of the marine outboard motor of FIG. 3.
Figure 5:
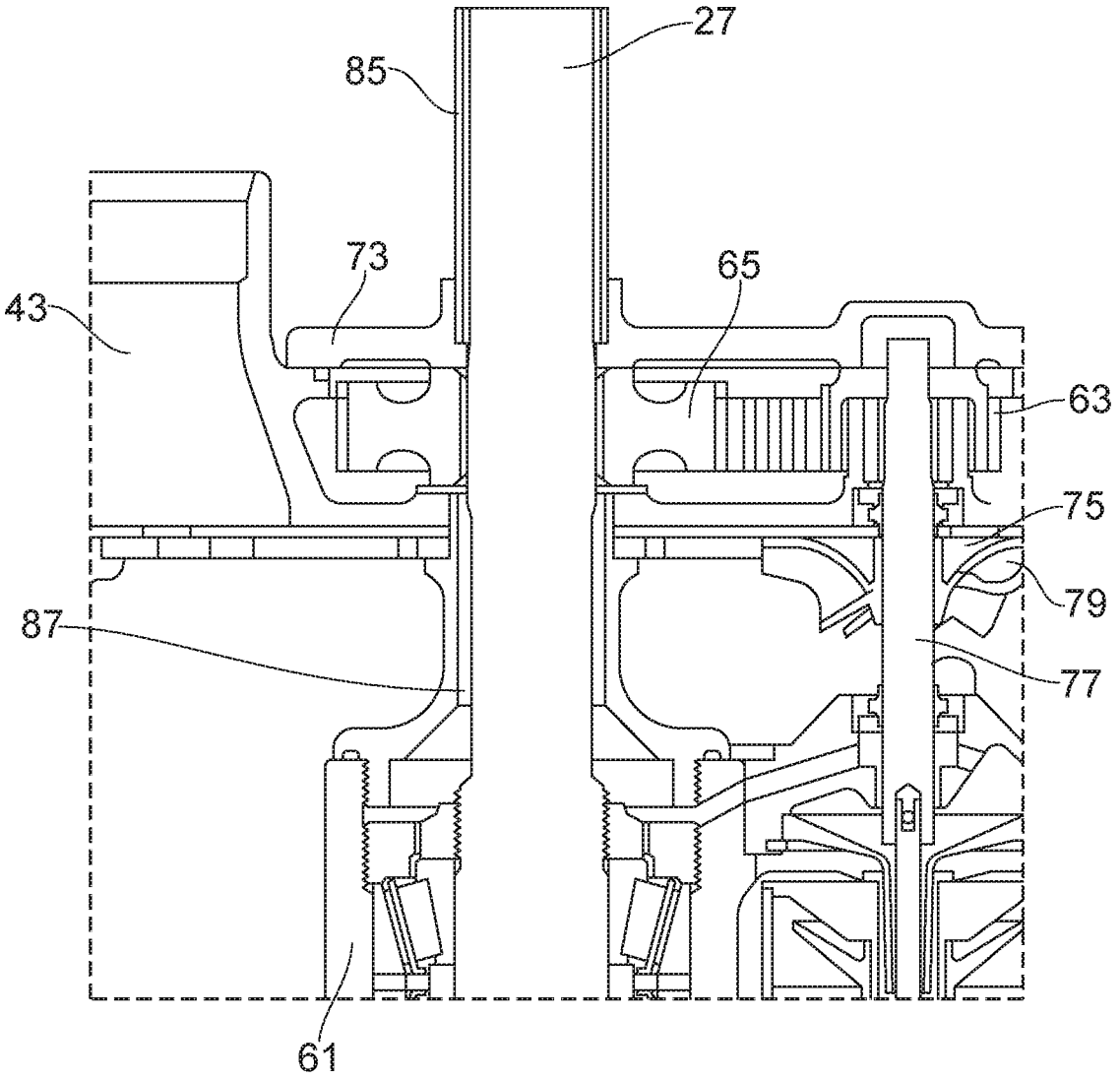
FIG. 5 shows an enlarged view of region A of FIG. 4.

Referring now to FIGS. 4 and 5, the mid-section 22 and lower-section 23 are illustrated.

In use, water from the body of water in which the marine outboard motor 2 is used, enters into the chambers 52, 53 of the housing 6 via the inlets 45, 47. The water pump 49 includes an impeller 75, which is configured to spin around its central axis within a pump housing 77. The water pump 49 is supplied with drawn water from the chambers 52, 53 via a pump inlet 79.

The rotating impeller 75 accelerates the drawn water as the drawn water moves across the impeller 75, generating a pressure differential across the water pump 49. This causes a pressurised flow of drawn water to be directed along the coolant flow path 43 via the water pump 49 to the internal combustion engine 100. In order to absorb heat from the internal combustion engine 100, the drawn water flows along at least one coolant passage (not shown) in the internal combustion engine 100 before returning to the body of water via one or more drain lines (not shown). In this way, the cooling system is configured to draw water into the housing 6 and to propel the drawn water along the coolant flow path 43 to the internal combustion engine 100.

In the illustrated embodiment, the water pump 49 is a centrifugal pump that is arranged to be separate from the drive shaft 27 (i.e. not mounted directly thereto) and is configured to be driven by the drive shaft 27. That is, the impellor 75 of the water pump 49 is rotated by rotation of the drive shaft 27. It will be appreciated that alternative types of water pump may be used in the marine outboard motor 2, for example a flexible impeller pump. It will also be appreciated that that in alternative arrangements the water pump 49 may be directly mounted to the drive shaft 27 or to a sleeve around the drive shaft 27, discussed in more detail below.

In order to drive the water pump 49, the marine outboard motor 2 includes a pump drive mechanism 63 that is connected to the drive shaft 27. The pump drive mechanism 63 is configured to supply the rotational energy of the drive shaft 27 to the water pump 49 to drive the impellor 75. The pump drive mechanism 63 is disposed in a pump drive mechanism housing 73.

In the arrangement shown, the water pump 49 includes a water pump drive shaft 71. The water pump drive shaft 71 is separate (i.e. axially offset) from the drive shaft 27 and is configured to be driven by the drive shaft 27.

In this example, the water pump 49 is coupled to the drive shaft 27 by a pump drive mechanism in the form of a drive gear 65 which is configured to transfer a drive force from the drive shaft 27 to the pump 49. The drive gear 65 is mounted concentrically on the drive shaft 27. The pump drive mechanism 63 also includes a driven gear 66 mounted concentrically on the water pump drive shaft 71. The drive gear 65 and driven gear 66 are in meshing engagement such that a drive force is able to be transferred from the drive shaft 27 to the pump 49.

In some embodiments, the water pump 49 is coupled to the drive shaft 27 by a pump drive mechanism 63 having a gear ratio of greater than 1:1. Such a 'step-up drive' can be advantageous where the typical rotational speed of the drive shaft 27 is unable to provide a sufficient flow rate through the water pump 49, for example where the diameter of the water pump 49 is limited by available space.

The marine outboard motor 2 is configured and arranged such that interaction between the drawn water (i.e. the drawn water within the chambers 52, 53 and the drawn water flowing along the flow path 43) and the surface of the drive shaft 27 is prevented or at least minimised. This allows for the entire of the drive shift 27 to be manufactured from a high strength material (e.g. high strength steel), without having to include corrosion resistant sections.

In the illustrated arrangement, the marine outboard motor 2 includes a sleeve 59 by which the drive shaft 27 is sealed from the coolant flow path 43. In order to seal the drive shaft 27 from drawn water within the housing 6 (i.e. within the chambers 52, 53 and within the coolant flow path 43), at least a part of the drive shaft 27 is encased within the sleeve 59.

In the illustrated embodiment, the sleeve 59 is arranged so as to be fixed within the housing 6. Put another way, when the sleeve 59 is mounted within the housing 6, the sleeve 59 does not rotate with respect to the housing 6, and the drive shaft 27 rotates within the sleeve 59 relative to the sleeve 59. In this way, static seals may be provided or formed between the sleeve 59 and the housing 6 to improve the reliability of the sealing of the drive shaft 27 away from the coolant flow path 43.

The sleeve 59 is mounted at its lower, or "second", end to the transmission housing 61 such that a seal is formed between the sleeve 59 and the transmission housing 61. In the illustrated embodiment, the sleeve 59 is mounted at its lower end to the transmission housing 61 via a screw thread, but it will be appreciated that any suitable mounting arrangement may be utilised in order to provide a seal between the sleeve 59 and the transmission housing 61.

The sleeve 59 is mounted at its upper, or "first", end to the adapter plate 41 such that a seal is formed between the sleeve 59 and the adapter plate 41. In the illustrated arrangement, the sleeve 59 is mounted at its upper end to the adapter plate 41 via a press fit (also known as an interference fit) and utilises two O-rings 81 to provide a seal between the sleeve 59 and the adaptor plate 41. It will be appreciated that any suitable mounting arrangement may be utilised in order to provide a seal between the sleeve 59 and the adapter plate 41, e.g. a screw thread fitting.

In the example shown, the sleeve 59 is provided as a series of separate sections. The sleeve 59 is provided in the form of a first or upper sleeve 83, a second or intermediate sleeve 85 and a third or lower sleeve 87.

The first sleeve 83 is mounted at its upper end to the adapter plate 41 such that a seal is formed therebetween. The first sleeve 83 is integrated into the housing 6 of the mid-section 22. That is, the first sleeve 83 formed from the same casting as the mid-section 22. In the embodiment shown, the mid-section 22 and the first sleeve 83 are formed from aluminium, but it will be appreciated that the material may vary to suit the application.

The second sleeve 85 is connected to the first sleeve 83. In the arrangement shown, the second sleeve 85 is connected to the first sleeve 83 via an interference fit. That is, an upper end of the second sleeve 85 is connected to a lower end of the first sleeve via an interference fit. It will be appreciated that although not illustrated, an O-ring may be provided to further seal the connection between the second sleeve 85 and the first sleeve 83. It will further be appreciated that any suitable mounting arrangement may be utilised in order to provide a seal between the second sleeve 85 and the first sleeve 83, e.g. a screw thread mounting arrangement.

The second sleeve 85 and third sleeve 87 are connected to the pump drive mechanism housing 73 such that the pump drive mechanism housing 73 is interposed between the second and third sleeves 85, 87. In this way, the drive shaft 27 and the pump drive mechanism 63 are sealed from the coolant flow path 43.

In the embodiment shown, the second sleeve 85 is connected to the pump drive mechanism housing 73 via an interference fit such that a seal is formed between the pump drive mechanism housing 73 and the second sleeve 85. It will be appreciated that although not illustrated, an O-ring may be provided to further seal the connection between the second sleeve 85 and the pump drive mechanism housing 73. It will further be appreciated that any suitable mounting arrangement may be utilised in order to provide a seal between the second sleeve 85 and the pump drive mechanism housing 73, e.g. a screw thread mounting arrangement. In the embodiment shown, the second sleeve 85 is formed from a plastics material, but it will be appreciated that any suitable material may be used such as a copper based alloy (e.g. bronze) or a steel alloy.

In the embodiment shown, the third sleeve 87 is integrated into the gear box/drive transmission. The third sleeve 87 is connected to the pump drive mechanism housing 73 via a screw thread such that a seal is formed between the pump drive mechanism housing 73 and the third sleeve 87. It will be appreciated that different connection arrangements, such as an interference fit, may be used. In the embodiment shown, the second sleeve 85 is formed from aluminium, but it will be appreciated that any suitable material may be used such as a copper based alloy (e.g. bronze) or a steel alloy.

Although the invention has been described above with reference to one or more preferred embodiments, it will be appreciated that various changes or modifications may be made without departing from the scope of the invention as defined in the appended claims.

The invention claimed is:

1. A marine outboard motor for a marine vessel, the marine outboard motor comprising:

a housing comprising a chamber and at least one inlet arranged to be submerged, in use, into a body of water in which the marine outboard motor is operated, in order to draw water into the chamber;

an engine assembly comprising an internal combustion engine;

a drive shaft positioned in the housing, wherein the drive shaft is coupled to the internal combustion engine to drive a propulsion arrangement;

a cooling system for cooling the internal combustion engine, the cooling system configured to convey drawn water along a coolant flow path through the housing to deliver the drawn water to the internal combustion engine, the cooling system comprises a water pump configured to propel the drawn water along the coolant flow path; and a sleeve by which the drive shaft is sealed from drawn water within the housing, the sleeve having first and second ends;

wherein at least a part of the drive shaft is encased within the sleeve;

wherein the water pump is separate from the drive shaft and is configured to be driven by the drive shaft; and wherein the water pump comprises a pump drive mechanism including a water pump drive shaft and the water pump drive shaft is separate from the drive shaft and is configured to be driven by the drive shaft.

2. The marine outboard motor according to claim 1, wherein the sleeve is fixed within the housing such that the drive shaft is rotatable relative to the sleeve.

3. The marine outboard motor according to claim 1, wherein the sleeve comprises a plurality of sleeve sections, each sleeve section encasing a different part of the drive shaft.

4. The marine outboard motor according to claim 1, wherein the housing comprises an exhaust system connected to the engine assembly by an adapter plate, and wherein the first end of the sleeve is sealingly coupled to the adapter plate.

5. The marine outboard motor according to claim 4, wherein a first sleeve section sealingly couples the housing to the adapter plate.

6. The marine outboard motor according to claim 5, wherein the first sleeve section is integrally formed with the housing.

7. A marine outboard motor for a marine vessel, the marine outboard motor comprising:

a housing comprising a chamber and at least one inlet arranged to be submerged, in use, into a body of water in which the marine outboard motor is operated, in order to draw water into the chamber;

an engine assembly comprising an internal combustion engine;

a drive shaft positioned in the housing, wherein the drive shaft is coupled to the internal combustion engine to drive a propulsion arrangement;

a cooling system for cooling the internal combustion engine, the cooling system configured to convey drawn water along a coolant flow path through the housing to deliver the drawn water to the internal combustion engine; and a sleeve by which the drive shaft is sealed from drawn water within the housing, the sleeve having first and second ends;

wherein at least a part of the drive shaft is encased within the sleeve, wherein the housing comprises an exhaust system connected to the engine assembly by an adapter plate, and wherein the first end of the sleeve is sealingly coupled to the adapter plate; and wherein a first sleeve section sealingly couples the housing to the adapter plate.

8. The marine outboard motor according to claim 1, comprising a drive transmission for the propulsion arrangement, the drive transmission being disposed within a drive transmission housing, wherein the second end of the sleeve is mounted to the transmission housing such that a seal is formed therebetween.

9. The marine outboard motor according to claim 8, wherein a water pump drive mechanism is disposed within a pump drive mechanism housing, wherein a second sleeve section is sealingly coupled between the first sleeve section and the pump drive mechanism housing, and wherein a third sleeve section is sealingly coupled between the transmission housing and the pump drive mechanism housing.

10. A marine outboard motor for a marine vessel, the marine outboard motor comprising:

a housing comprising a chamber and at least one inlet arranged to be submerged, in use, into a body of water in which the marine outboard motor is operated, in order to draw water into the chamber;

an engine assembly comprising an internal combustion engine;

a drive shaft positioned in the housing, wherein the drive shaft is coupled to the internal combustion engine to drive a propulsion arrangement;

a cooling system for cooling the internal combustion engine, the cooling system configured to convey drawn water along a coolant flow path through the housing to deliver the drawn water to the internal combustion engine, the cooling system comprises a water pump configured to propel the drawn water along the coolant flow path; and a sleeve by which the drive shaft is sealed from drawn water within the housing, the sleeve having first and second ends;

wherein at least a part of the drive shaft is encased within the sleeve; and wherein the water pump is coupled to the drive shaft by a pump drive mechanism having a gear ratio of greater than 1:1.

11. The marine outboard motor according to claim 10, wherein the pump drive mechanism comprises a drive gear mounted concentrically on the drive shaft and a driven gear mounted concentrically on the water pump drive shaft, wherein the drive gear and the driven gear are in meshing engagement.

12. The marine outboard motor according to claim 1, wherein the driveshaft extends in a vertical direction.

13. The marine outboard motor according to claim 1, wherein the internal combustion engine is a diesel engine.

14. The marine vessel comprising the marine outboard motor according to claim 1.

15. The marine outboard motor according to claim 6, wherein the first sleeve section is integrally cast with the housing.

* * * * *